US005707302A

United States Patent [19]

Leon et al.

[11] Patent Number: 5,707,302

[45] Date of Patent: Jan. 13, 1998

[54] IRON-STYLE GOLF CLUB

[76] Inventors: Joseph A. Leon, 15 Weston St.; Richard F. Zopf, 19 Fairway Dr. Apt.21, both of Derry, N.H. 03038

[21] Appl. No.: 610,112

[22] Filed: Feb. 29, 1996

[51] Int. Cl.[6] ..... A63B 53/04

[52] U.S. Cl. ..... 473/324; 473/332; 473/350

[58] Field of Search ..... 473/324, 329, 473/332, 345, 349, 350, 282, 377, 351

[56] References Cited

U.S. PATENT DOCUMENTS

| | | | |
|---|---|---|---|
| 2,846,228 | 8/1958 | Reach | 473/332 |
| 2,908,502 | 10/1959 | Bradstreet | 273/DIG. 33 |
| 4,768,787 | 9/1988 | Shira | 473/331 |
| 4,951,953 | 8/1990 | Kim | 473/320 |
| 5,290,036 | 3/1994 | Fenton | 473/332 |
| 5,316,298 | 5/1994 | Hutin | 473/332 |
| 5,411,255 | 5/1995 | Kurashima | 473/332 |

*Primary Examiner*—Sebastiano Passaniti
*Attorney, Agent, or Firm*—James T. Sullivan

[57] ABSTRACT

An improved, iron-style golf club, which comprises a substantially perimeter weighted clubhead, including an exceptionally hard coating, which is metallurgically bonded to the front face of the clubhead. The rear face of the club comprises concentric recesses substantially co-located at the center of gravity of the clubhead. The recesses are sequentially filled with a variable amount of elastomer material, which is chemically bonded within the recesses. The elastomer acts as both a shock absorber to minimize the shock experienced when the superhard clubface impacts a golf ball and simultaneously acts as a swingweighting medium to variably adjust the swingweight of the club.

6 Claims, 1 Drawing Sheet

IRON-STYLE GOLF CLUB

FIELD OF THE INVENTION

The present invention relates to the field of golf club design. Specifically, the invention is directed to improved "iron-style" golf clubs, which comprise an exceptionally hard, metallurgically bonded face material on the area of the face of the clubhead where the same strikes a golf ball and a shock absorbing elastomeric insert chemically bonded to one of a plurality of concentric recesses located on a back side of said clubhead. In addition to absorbing the shock created when the super-hard face of the clubhead impacts a golf ball, the elastomeric insert allows for variable swing weighting of the improved golf club to provide a custom fit for a specific user. In a preferred embodiment, the elastomeric insert is an ultraviolet light curable polymer, which can be introduced into the recesses in liquid form and cured to a pliable solid state therein.

BACKGROUND OF THE INVENTION

Over the recent years, golf clubs have undergone significant design improvements. Perhaps the most significant improvement in golf club design has been the introduction of perimeter weighting to both iron-style and wood-style clubheads. Perimeter weighting encompasses the removal of metal from central portions of a clubhead and the redistribution thereof to the perimeter of the head. This results in an expansion of the "sweet spot" of the clubface. When a golf ball is struck by a club substantially at its sweet spot, the golf bail will experience its optimal trajectory and distance. While great advances have been made in weighting technology of clubheads themselves, the removal and redistribution of mass in clubheads has affected the swing weight of many perimeter weighted clubs.

Historically, golf clubs have been "swing-weighted" to fit specific users. In general, swing-weighting comprises adjusting the weight of a club's head in either by either adding some amount of a weighting medium, which is typically lead, to either the club head of, in the alternative to the butt end of an attached golf club shaft. When a quantity of the weighting medium is added to the head, it can be accomplished in any number of ways. One common method includes pouring either lead powder, shot or putty down an attached golf club shaft and then press fitting a small cork into the shaft, above the powder, shot or putty in order to retain the same in position in the lower part of the golf club shaft. Another method includes attaching lead tape to the back of an iron head. While these two prior art methods do increase a club's swing weight, they both accomplish the same with some undesirable side effects. The major drawback of the first method is that adding weight to the lower part of the club's shaft, where it is bonded to the iron head, changes the center of gravity of the club. Thus, a shifting in the "sweet spot" of the club will be experienced. With the second prior art method, the lead tape can be physically affixed to the rear of the club head in a position coinciding with the center of gravity of the club and thus, the "sweet spot" will not be materially, adversely affected. However, this second method tends to be relatively unsightly and is but a temporary solution to the swing weight problem since the tape's adhesive will tend to loosen with time and as the club swingweighted using this method is exposed to rain and the like.

The disclosed golf club offers a number of advances over prior art golf clubs and methods of swing-weighting the same. A first, and significant advantage, is that the disclosed golf club comprises a means of adjusting the swing weight of the club by adding mass substantially at the center of gravity of the clubhead, thus not affecting the club's sweet spot. Additionally, the disclosed invention accomplishes the swingweighting process in a variable manner. Thus, clubs can be custom weighted to satisfy golfers with differing swing speeds and tempos. Another advantage of the disclosed invention is that the swing weighting medium can be removed and replaced with additional matter, or even added to as a golfer's swing characteristics change.

In addition to the center of gravity-located variable swing weighting system incorporated into the disclosed golf club, the invention comprises, in combination therewith, an exceptionally hard clubface coating, which is metallurgically bonded to the clubface in the area where the same contacts a golf ball at the impact point of a golf swing. Superhard clubface materials are not new. In fact they are well known in the art of wood-style golf club design, where clubface deflection is a significant concern. In fact, wood-style clubs have incorporated ceramic, glass, graphite and other clubface inserts in an effort to minimize club face deflection at impact in order to maximize the transfer of momentum from a moving clubhead to a golf ball at impact. However, the typical teachings in the art today prefer softer allow iron-style clubs, where club "feel" is considered of paramount importance. In fact most touring professional golfers still use forged, blade-style irons, which are made of steel alloys that provide optimum club feel. Unfortunately, the average golfer does not possess the skill to truly "feel" the difference when his or her club strikes a golf ball at different positions on the clubface, let alone control the same. Therefore, the applicant has considered the possibility of inventions contrary to popular teaching in the industry and has introduced the concept of superhard clubfaces to iron-style golf clubs. However, one drawback of such a configuration is that significant shock will be experienced when the club impact the golf ball. In order to reduce such impact shock, the applicants, have incorporated a shock absorbing polymer to the rear side of the disclosed clubhead. This, chemically bonded shock absorber is the same medium used for swingweighting the club discussed above. Thus a single insert on the rear of the clubhead satisfies the dual purposes of shock absorption and variable swing weighting. This, when coupled with the superhard clubface surface coating is believed to render the applicant's invention a truly new, useful and non-obvious invention.

OBJECTS OF THE INVENTION

Accordingly, it is an object of the present invention to provide an improved golf club that comprises a metalurgically bonded clubface coating to minimize clubface deflection at impact.

Another object of the invention is to provide an improved golf club that comprises a variable swingweighting system, corresponding to the center of gravity of the clubhead so that swing weight can be adjusted with out adversely affecting the club's sweet spot.

Yet another object of the invention is to provide an improved golf club that comprises a shock absorbing insert on the rear face of the club to absorb the shock created when the superhard face of the club, while traveling at a great rate of speed, impacts a golf ball.

Another object of the invention is to provide an improved golf club where the shock absorbing and swing weighting functions are satisfied by a single component..

These and still other objects of the disclosed invention will become apparent from the following description.

SUMMARY OF THE INVENTION

The disclosed invention is an improved, iron-style golf club, which comprises a substantially perimeter weighted clubhead. The clubhead has a front face and a rear face, the later of which is recessed and surrounded by the perimeter weighting portions of the clubhead. The front face of the clubhead comprises an exceptionally hard face coating, which is metallurgically bonded to the front face of the club. The rear face of the club comprises concentric recesses substantially co-located at the center of gravity of the clubhead. The recesses can be sequentially filled with a polymer material, which is chemically bonded within the recesses. The polymer acts as both a shock absorber to minimize the shock experienced when the superhard clubface impacts a golf ball and simultaneously acts as a swingweighting medium to variably adjust the swing weight of the club.

DETAILED DESCRIPTION OF THE INVENTION

Figure 1:
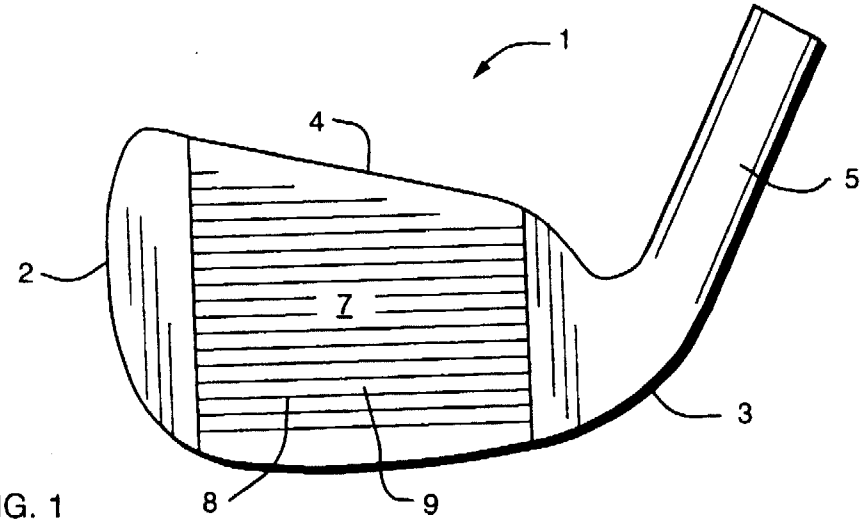
FIG. 1 is a front view of one embodiment of the invention, showing the clubface and the superhard coating metallurgically bonded thereon.
Figure 3:
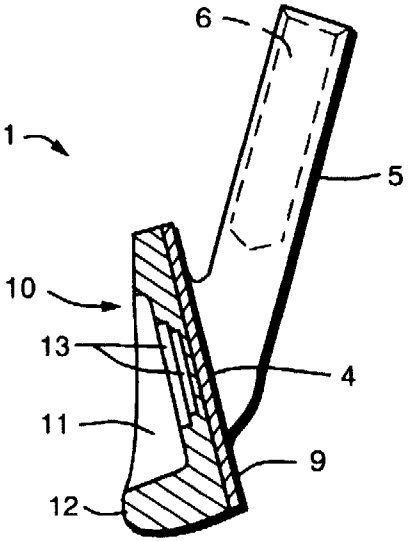
FIG. 3 is a sectional side view of Section AA of FIG. 2, showing the depth of the concentric recesses and the perimeter weighting system incorporated into the iron-style golf club of the disclosed invention.
Figure 2:
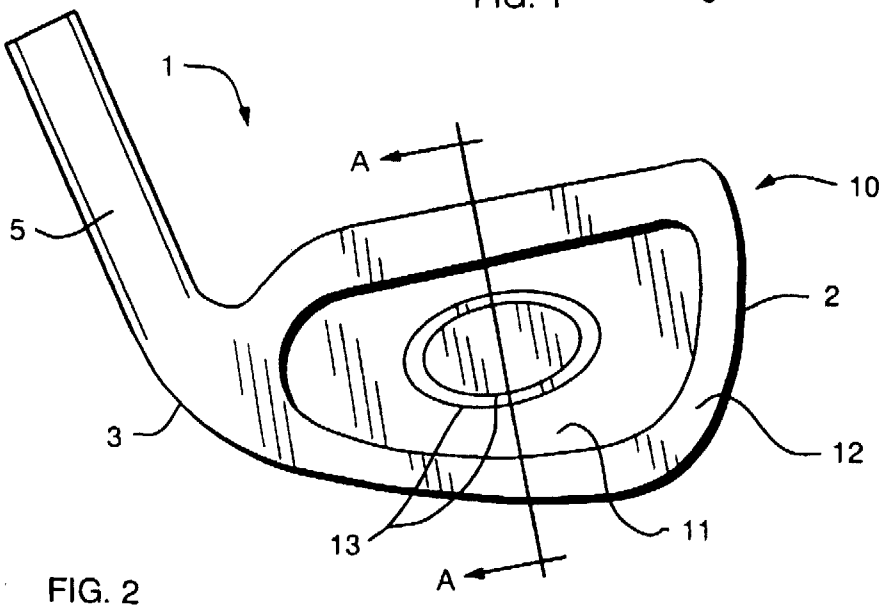
FIG. 2 is a rear view of the embodiment of FIG. 1, showing the concentric swingweighting recesses co-located at the center of gravity of the clubhead.

Referring now to the figures, an iron-style golf club head is shown and is generally designated by the numeral 1. Golf club head 1 is preferably a cavity back style clubhead, as shown in FIGS. 2 and 3. However, the principles of the disclosed invention are applicable to blade style golf club heads as well. Golf club 1 has a toe area 2, a heel area 3, a substantially flat clubface 4, and a hozel 5, which is a generally cylindrically shaped protrusion extending in a generally upward direction. Hozel 5 comprises a cylindrical bore 6, which is where a golf club shaft (not shown) is attached to the clubhead 1 using standard chemical bonding techniques, which are well known to those skilled in the art of golf club design and manufacture.

In the preferred embodiment of the disclosed invention, clubface 4 comprises an area 7 which is specifically configured for striking a golf ball. As with prior art golf clubs, striking area 7 comprises recessed grooves 8, substantially horizontally oriented and of a size and shape that correspond to United States Golf Association (USGA) rules. However, in a manner unlike any prior art club heads, the disclosed invention comprises an exceptionally hard face coating 9, which is metallurgically bonded to the striking area of the clubhead. The coating utilized exhibits a Rockwell hardness factor of 75. Diamonds, which are commonly considered the hardest naturally occurring material exhibit a Rockwell hardness of 80. Typical steel hardnesses range from 50 to 65 on the Rockwell hardness scale. Therefore, it can be seen that the face coating 9 incorporated into the disclosed golf club results in a club face with a surface hardness substantially greater than that of standard prior art golf clubs.

Preferably, the super hard face coating is applied to a cast or forged iron head by a vacuum deposit process. Vacuum deposition of a minimum of 0.5 microns of the super hard coating is required to substantially effect the hardness of the club face. The vacuum deposition process allows the coating to be metallurgically bonded to the face of the club and thus, the surface coating will not chip, peel or suffer any significant degradation over extended periods of use. Alternatively, the super hard face may be an insert of a ceramic material diffusion bonded to the face of the golf club.

The inclusion of a super hard face on an iron style golf dub will result in an increase in the distance a golf ball will travel when struck with such a club since the super hard face will minimize any clubface deformation at the point of impact and thus result in a transfer of a maximum amount of momentum from a rapidly traveling golf club to a golf ball lying in a smile state on the ground or on a golf tee. While increased distance is a positive benefit for most golfers, many golfers express the need for golf shot control, especially when using their iron style clubs. A super hard face surface of such an iron style golf club could tend to result in a higher level of shock when a golf ball is struck. Therefore, an integral portion of the disclosed invention is a shock absorbing insert included on the rear face of the club head to help absorb the additional shock, which may be experienced when a ball is struck with the disclosed club. The shock absorbing insert also serves the dual purpose of allowing for optimum adjustability of the swingweight of the disclosed golf club as described below.

The rear surface 10 of golf dub head 1 is preferably of a cavity back design and includes a recessed central portion 11, surrounded by a raised perimeter section 12, which accomplishes the perimeter weighting purpose that is well known in the art. However, unlike most prior art, perimeter weighted iron style golf club heads, the disclosed clubhead includes a plurality of additional concentric recesses 13 in the recessed central portion 11. These concentric recesses 13 are substantially co-located with the center of gravity of the golf club head. The importance of this feature will be explained more fully below in conjunction with a discussion of the swing weighting features provided for thereby.

The embodiment shown in FIGS. 2 and 3 incorporates two concentric recesses. However, any number of recesses may be included in the clubhead's design. The concentric recesses are filled with a polymer material, which is preferably an elastomer to aid in the absorption of the shock which may be created by the super hard striking surface during impact. The recesses may be filled incrementally, in increments of between 1 and about 15 grams.

The preferred materials and method of applying the same to result in the polymer insert are ultraviolet (UV) light curable acrylates. These acrylates are supplied to the recesses incrementally in liquid form and are then cured in place using an ultraviolet light source. The light source may be a medium pressure mercury vapor lamp. However, even the ultraviolet rays of sunlight will cure the acrylates. In order to ensure adequate chemical bonding to the rear surface of the golf club head, the acrylates are applied in a two step process. First, a UV resin primer, comprising 100% solids, is applied to the rear surface of a club head with is slightly warmed. The primer will adhere to stainless steel, mild carbon steel, titanium and most similar alloys. The liquid primer is then cured by being exposed to a UV light source, such as a medium pressure mercury vapor lamp for a very short period—generally on the order of magnitude of a few seconds only. The UV resin primer is then followed by a top coat of UV curable acrylate, which is measured in terms of weight as it is applied to the concentric recesses on the rear surface of the disclosed golf club. By applying varying amounts of top coat, the weight of the golf club head can be adjusted, thus resulting in the variable swingweight feature of the disclosed golf club. To satisfy aesthetic concerns, the UV curable acrylates can be formulated in any color or degree of gloss. The fully cured acrylate elastomer system can then absorb the shock created by the super hard surface face when it impacts a golf ball.

The significance of the co-location of the concentric recesses 13 on the rear surface 11 of the disclosed golf club is that is allows for the adjustment of the club's swing weight without substantially affecting the center of gravity of the golf club. Prior art methods of swingweighting golf clubs consisted of either pouring lead powder, shot or putty down a golf club shaft and inserting a cork into the shaft to retain the lead in position at the bottom of the shaft or adding lead tape to the rear surface of a golf club head. The first method resulted in the shifting of the center of gravity of the golf club towards the heel area of the club and thus reduced the club's sweet spot. The second method on the other hand could result in minimal shifting of the center of gravity of the club. However, the lead tape method is not a permanent method of adjusting the swingweight of a club. In fact, the tape method is generally used in a trial and error process of finding the optimum swing weight of a club for a specific golfer. Additionally the adhesive used on lead tape tends to degrade over time, especially when the tape is exposed to rain and the like.

Thus, the disclosed invention allows for the adjustment of the swingweight of a golf club without substantially affecting the center of gravity of the club by co-locating the areas to which weights are attached with the center of gravity of the clubhead. Additionally, the weights utilized by the disclosed invention comprise variable quantities of UV curable elastomers, which are cured in position to the areas on the golf club configured to accept such materials. By increasing the amount of elastomer added to a clubhead, the club's swingweight is increased. Finally, if adjustment of swingweight is desired after the club is first weighted, the elastomer insert can be removed and a different quantity of elastomer can be added to the clubhead.

Various other changes coming within the scope of the invention may suggest themselves to those skilled in the art: hence, the invention is not limited to the specific embodiment shown or described, but the same is intended to be merely exemplary. It should be understood that numerous other modifications and embodiments can be devised by those skilled in the art that will fall within the spirit and scope of the principles of the invention.

What is claimed is:

1. An improved golf club comprising a golf club head including an exceptionally hard clubface combined with a combination variable swingweight adjustment-shock absorption system to allow for swingweight adjustment and to absorb any excess shock experienced when said exceptionally hard face impacts a golf ball, said variable swingweight system substantially co-located at the location of the center of gravity of said club such that the swingweight of said club can be adjusted without substantially affecting the center of cavity of said club, wherein said combination swingweight adjustment-shock absorption system comprises an ultraviolet (UV) light curable elastomer system, which can be added to a rear face of said clubhead an any number of a plurality of concentric recesses in said rear face of said clubhead, said recesses being substantially co-located with the location of said center of gravity of said clubhead.

2. The improved golf club of claim 1, wherein said UV light curable elastomer system comprises a UV light curable primer and a UV light curable top coat.

3. A method of variably adjusting the swingweight of a golf club comprising applying an ultraviolet (UV) light curable primer to a rear surface of a golf club head, curing said primer by exposing said rear surface of said golf club head to a UV light source for a short period of time, applying a variable quantity of a UV light curable top coat to said rear surface of said golf club head on top of said primer, said quantity of top coat being selected to coincide with the amount of weight desired to be added to said golf club head, and curing said top coat by exposing said top coat to a UV light source.

4. The method of variably adjusting the swingweight of a golf club claimed in claim 3, wherein said rear surface comprises a plurality of concentric recesses substantially co-located with the center of gravity of said golf club head.

5. An improved golf club comprising a golf club head including an exceptionally hard clubface in combination with a variable swingweight adjustment-shock absorption system to allow for swingweight adjustment and to absorb any excess shock experienced when said exceptionally hard face impacts a golf ball, wherein said variable swingweight adjustment—shock absorbtion system comprises a plurality of concentric recesses located in a rear surface of said club head, said recesses being substantially co-located at the location of the center of gravity of said club head and incrementally filled with a polymer material such that the swingweight of said club can be adjusted without substantially affecting the location of the center of gravity of said golf club.

6. The improved golf club as claimed in claim 5, wherein said variable swingweight adjustment—shock absorption system further comprises an elastomer with which said recesses are filled.

* * * * *